US006314603B1

(12) United States Patent
Sobo

(10) Patent No.: US 6,314,603 B1
(45) Date of Patent: Nov. 13, 2001

(54) CAR WASH SYSTEM

(76) Inventor: Michael Sobo, 200 White Plains Rd., Tarrytown, NY (US) 10591

( * ) Notice: Subject to any disclaimer, the term of this patent is extended or adjusted under 35 U.S.C. 154(b) by 0 days.

(21) Appl. No.: 09/692,880

(22) Filed: Oct. 23, 2000

(51) Int. Cl.[7] ..... A46B 13/06
(52) U.S. Cl. ..... 15/29; 15/24
(58) Field of Search ..... 15/24, 29

(56) References Cited

U.S. PATENT DOCUMENTS 846,636 * 3/1907 Wensinger .
919,756 * 4/1909 Patrick .
1,055,572 * 3/1913 Thompson .
2,540,240 * 2/1951 Boyle .
5,842,250 12/1998 Zhadonov .

FOREIGN PATENT DOCUMENTS

3113645 * 10/1982 (DE) .

* cited by examiner

*Primary Examiner*—Randall E. Chin
(74) *Attorney, Agent, or Firm*—Myron Amer, P.C.

(57) ABSTRACT

A rotor for home car washing use having a radially oriented inlet at the distal end of a rotor in rotation and in movement against the car vertical sides, i.e., the larger surfaces requiring cleaning, in which washing fluid supplied through the tube flows into the lower half of the rotor, aided by gravity, to effectively power the rotor in rotation.

1 Claim, 1 Drawing Sheet

CAR WASH SYSTEM

The present invention relates generally to a car owner's do-it-yourself car washing device and, more particularly, to a wash water-powered rotor for attachment to a brush or mop-type fabric construction suitable for cleaning a car surface.

BACKGROUND OF THE INVENTION

Field of the Invention

A surface-cleaning device, intended for windows but applicable for cars, is illustrated and described in U.S. Pat. No. 1,682,216 for "Window Cleaning Device" issued to F. H. Dellaree et al. on Jan. 9, 1926, and obviates the tedium of cleaning effort on the part of the user by using a motor to rotate the cleaning instrumentality which could be in the form of a mop, rag, brush or any other device adapted for cleaning a surface.

U.S. Pat. No. 5,842,250 for "Cleaning Device" issued to Zhadanow on Dec. 1, 1998 improves on the '216 and similar motor-powered prior patents by proposing a mop-like fabric cleaning device and suggesting that as a substitute for a motor that the pressure of the wash water be used to advantage to rotate the proposed cleaning device. The suggestion of the '250 patent is implemented by the wash water-powered rotor of the present invention, and the implementation is carried out to the extent that the attachment to the rotor is readily achieved using the construction of the '250 cleaning device. This construction, by this reference to U.S. Pat. No. 5,842,250, is intended to be incorporated herein pursuant to MPEP 2163.07(b).

SUMMARY OF THE INVENTION

Broadly, it is an object of the present invention to provide a wash water-powered rotor for use with a car wash cleaning instrumentality overcoming the foregoing and other shortcomings of the prior art.

More particularly, it is an object to provide a wash water-powered rotor which facilitates washing clean the vertical sides of the car, whether on the driver's or passenger's side by using to advantage gravity flow of the wash water, all as will be better understood as the description proceeds.

BRIEF DESCRIPTION OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 1:
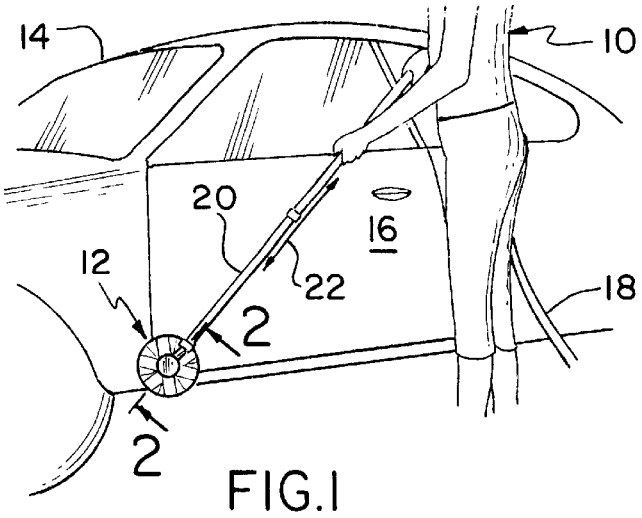
FIG. 1 is a front elevational view of a home car-washing device as it would typically be used.
Figure 2:
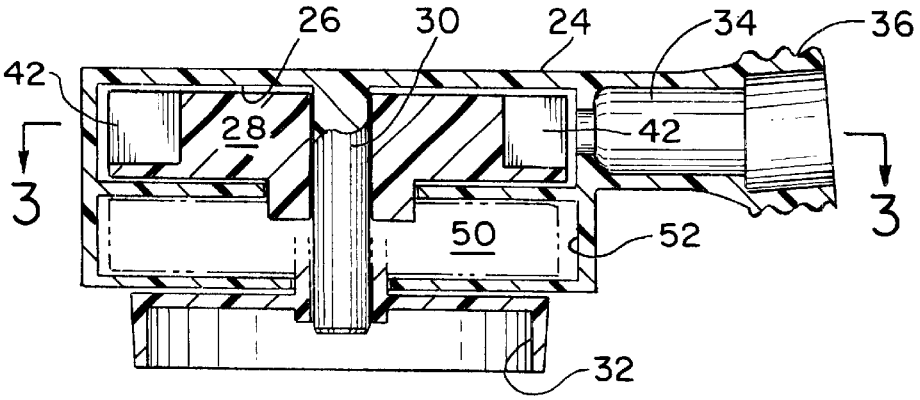
FIG. 2 is an enlarged scale sectional view taken along line 2—2 of FIG. 1.
Figure 3:
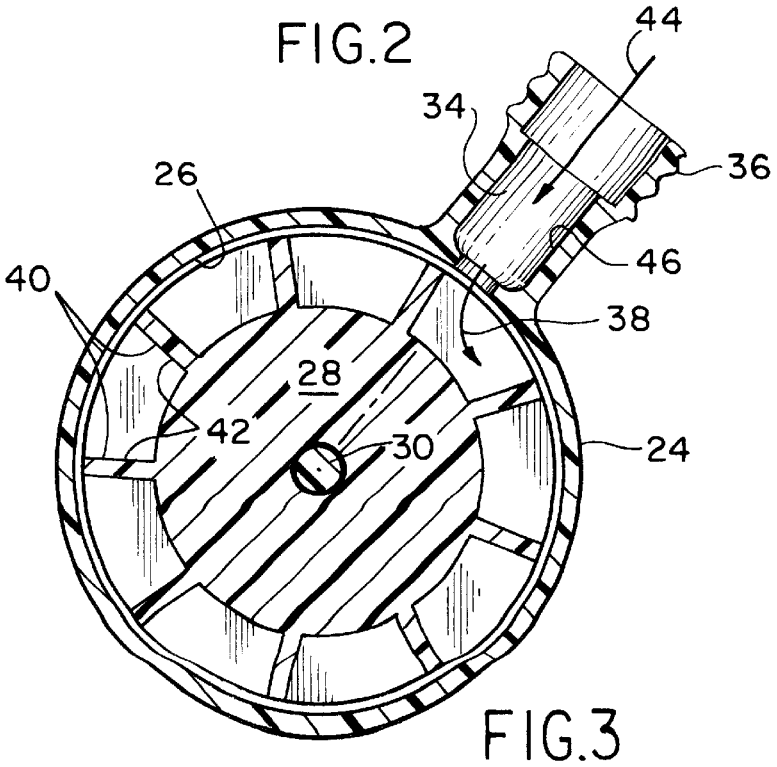
FIG. 3 is a sectional view taken along line 3—3 of FIG. 2.

Shown in FIG. 1 is a car owner 10 using a car-washing device, generally designated 12 and soon to be more specifically described in connection with FIGS. 2 and 3, being used for the purposes intended, namely to wash his/her car 14, a chore which primarily entails the washing removal of soil from the car vertical side surfaces 16, that shown in FIG. 1 being on the driver's side and, of course, duplicated on the passenger's side. As shown in FIG. 1, applied to the surfaces 16 the device 12 is angularly oriented, such that water from a source spigot (not shown) is delivered through a hose 18 to a plastic tube 20, serving as a handle, to the device 12, and the nature of the flow is in a correspondingly angular orientation, depicted by arrow 22, the significance of which will now be explained in connection with FIGS. 2, 3.

Device 12 has a housing 24 which bounds a compartment 26 in which a rotor 28 is mounted for rotational movement about an axis 30 and powers in rotation a holder 32 for a brush or possibly cloth strips, neither shown as being unnecessary because well known, with the result that soil is removed from the vertical car surfaces 16. Integral to the housing 24 is an inlet 34, threadably engaged at 36, to the distal end of the tubular handle 20 such that the wash water by gravity flow 38 enters between the spacing 40 between adjacent radial vanes, individually and collectively designated 42, of the pair of vanes 42 that happens to be in the flow path 44 through the flow passage 46 of the inlet 34. This gravity flow 38 is used to advantage to rotate the rotor 28 the same whether on the driver's side or on the passenger's side and, most important, is functional to do so even though the inlet 34 is oriented radially of the device housing 24 providing the flow path 44. It is believed that without the directional gravity flow 38 the inlet would have to be oriented tangentially of the device housing 24 and, in such an orientation, would favor washing only one vertical side but not the other, whereas the radial orientation has no bias one way or the other.

In practice, it has been determined that good results occur if the rotor 28 is urged in rotation for 19 revolutions to each rotation of the brush/cloth strip holder 32 and this is achieved using a gear train 50 in a housing compartment 52 left for this component.

While the car washing device disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For washing vertically oriented car driver and passenger side surfaces, a washing device comprising a rotatably mounted car-washing rotor having circumferentially spaced apart planar vanes each coincident with a radius of said rotor, a cylindrical tube in attached relation to said rotor for positioning said rotor in relation to said vertically oriented car driver and passenger side surfaces, an internal flow passage in said cylindrical tube, and an inlet of said rotor oriented radially and in an alignment coincident with a diameter of said rotor, said rotor inlet operatively connected to said cylindrical tube flow passage, whereby fluid flow into said rotor is urged by gravity in descending movement during washing either said driver or passenger vertical side surfaces to contribute to applying effective rotation-urging pressure against said rotor vanes.

* * * * *